US005927396A

United States Patent [19]

Damsohn et al.

[11] Patent Number: 5,927,396

[45] Date of Patent: Jul. 27, 1999

[54] MULTI-FLUID HEAT TRANSFER DEVICE HAVING A PLATE STACK CONSTRUCTION

[75] Inventors: Herbert Damsohn, Aichwald; Conrad Pfender, Besigheim; Walter Wolf, Oppenweiler-Zell; Eberhard Zwittig, Hochdorf, all of Germany

[73] Assignee: Behr GmbH & Co., Stuttgart, Germany

[21] Appl. No.: 08/714,531

[22] Filed: Sep. 16, 1996

[30] Foreign Application Priority Data

Sep. 28, 1995 [DE] Germany ..... 195 36 115

[51] Int. Cl.[6] ..... F28F 3/08

[52] U.S. Cl. ..... 165/167; 165/135; 165/140; 165/144

[58] Field of Search ..... 165/167, 140, 165/135, 144, 145

[56] References Cited

U.S. PATENT DOCUMENTS

| | | | |
|---|---|---|---|
| 1,870,457 | 8/1932 | Kenney | 165/140 |
| 2,528,013 | 10/1950 | Morris | 165/167 |
| 3,017,161 | 1/1962 | Slaasted et al. . | |
| 3,513,907 | 5/1970 | Hughes | 165/166 X |
| 3,587,731 | 6/1971 | Hays | 165/140 |
| 4,516,632 | 5/1985 | Swift et al. | 165/167 |
| 4,815,534 | 3/1989 | Fuerschbach . | |
| 5,180,004 | 1/1993 | Nguyen | 165/140 |
| 5,409,058 | 4/1995 | Yuasa et al. | 165/167 |
| 5,720,341 | 2/1998 | Watanabe et al. | 165/135 |

FOREIGN PATENT DOCUMENTS

| | | | |
|---|---|---|---|
| 929698 | 1/1948 | France . | |
| 2412805 | 7/1979 | France . | |
| 2 583 864 | 12/1986 | France . | |
| 540918 | 12/1931 | Germany . | |
| 3206397C2 | 10/1982 | Germany . | |
| 3709278C2 | 3/1989 | Germany . | |
| 993 | 1/1981 | Japan | 165/140 |
| 306798 | 12/1989 | Japan | 165/167 |
| 629385 | 9/1949 | United Kingdom . | |

*Primary Examiner*—Leonard Leo

*Attorney, Agent, or Firm*—Evenson, McKeown, Edwards & Lenahan, PLLC

[57] ABSTRACT

A multi-fluid heat transfer device having a plate stack construction is disclosed which includes several plates which are stacked above one another and are provided with openings, through which several thermally interacting fluids can be guided. A construction is provided which consists of at least one first and at least one second flow duct plate unit which are arranged in the plate stack in an alternating manner, as well as of an intermediate connection cover plate unit, the first flow duct plate unit having one group and the second flow duct plate unit having two separate groups of respective side-by-side flow duct openings. Furthermore, connection duct openings for forming one distributor duct pair and collector duct pair respectively for each group of flow duct openings are placed in all plate units. As a result, a compactly constructed heat transfer device of a high heat transfer output is implemented by means of low manufacturing expenditures. The heat transfer device is usable as a high-temperature battery cooling element for an electric vehicle.

6 Claims, 2 Drawing Sheets

MULTI-FLUID HEAT TRANSFER DEVICE HAVING A PLATE STACK CONSTRUCTION

BACKGROUND AND SUMMARY OF THE INVENTION

This invention relates to a heat transfer device which is suitable for the flowing-through of several fluids and has a construction of several plates which are stacked above one another and are provided with openings.

Heat transfer devices of this type are described, for example, in German Patent Document DE 32 06 397 C2. There, plates of a same type, which are each provided with parallel rows of oblong openings, are stacked on one another in such a manner that the openings of one plate are in a fluid connection with adjacent openings of the same row of an adjoining plate. In this manner, each group of superimposed rows of openings forms a two-dimensional flow duct network, the network planes being situated in parallel to the stacking direction and the individual networks having no fluid connection with one another within the stack. By means of suitable inflow and outflow devices on the sides of the stack toward which the networks are open, the individual networks can be divided into several groups, a specific fluid flowing through each of them.

From German Patent Document DE 37 09 278 C2, a heat transfer device having a plate stack construction is known in the case of which the plates, which are stacked upon one another, are provided on one of the two flat sides with longitudinal grooves which are situated side-by-side and which are used as flow ducts. During the stacking, as required, adjacent plates are then arranged to be tilted with the same orientation by 180° with respect to one another or are arranged to be rotated by 90° with respect to one another, whereby co-current flow or countercurrent flow arrangements with a larger or smaller duct cross-section or cross-current flow arrangements are formed.

In the applicant's German Patent Application 195 28 117.9 (corresponding U.S. application filed Aug. 1, 1996 under Ser. No. 08/691,897, now U.S. Pat. No. 5,718,286) which is no prior publication, a heat transfer device of the initially mentioned type is described in the case of which a plate stack construction is provided which consists of flow duct plate units and connection cover plate units which are alternately stacked on one another. The flow duct plate units are provided with flow duct openings extending between two lateral areas as well as with connection duct openings separated therefrom, while in the connection cover plate units, connection duct openings on at least two lateral areas are provided in such a manner that they suitably overlap with respective equal-sided ends of the flow duct openings of an adjoining flow duct plate unit as well as a connection duct opening of the flow duct plate unit adjoining on the other side. As a result, two separate flow duct systems are formed through which two fluids can flow, depending on the mutual orientation of flow duct plate units following one another in the stack, in the crosscurrent, the countercurrent or the co-current transversely to the stack direction.

For certain applications, there is a demand for heat transfer devices by means of which, by means of a thermal interaction with a working fluid, a fluid can be tempered, that is, cooled or heated beyond a desired temperature value, and can subsequently be brought to the desired temperature by means of the thermal interaction with the fluid flow existing in front of the heat transfer area of the working fluid. Thus, for example, high temperature batteries for driving electric vehicles typically have a working temperature of approximately 300° C., in which case the temperature continues to rise in phases of a high current consumption because of internal losses. For preventing damage, the battery must be cooled, for the purpose of which, as a rule, silicone fluid is circulated as the heat transfer medium through the battery. By means of an oil/water heat transfer is device outside the battery, the oil is recooled, in which case, for reasons of space, heat transfer devices are desired which are as compact as possible. The silicone fluid must now, on the one hand, be cooled to a temperature which is compatible with an assigned fluid pump; on the other hand, the fluid must not be returned to the battery at such a low temperature because otherwise, additionally, thermal energy must be generated in the interior of the battery with the result of a loss of electric energy and therefore of vehicle range. A heat transfer device is therefore required by means of which heat is first withdrawn from the fluid coming out of the battery until it reaches a pump-compatible temperature, and by means of which, the fluid, after flowing through the pump, is heated again to a desirable battery inlet temperature.

The invention is based on the technical problem of providing a heat transfer device of the initially mentioned type which can be produced and mounted at relatively low expenditures, has a high heat transfer output in the existing required space and is suitable particularly for applications in which, as in the above-described case of a high-temperature battery cooling, a fluid is to be cooled or heated by a working fluid beyond a desired temperature value and subsequently is to be brought to the desired temperature value by the thermal interaction with the fluid flow existing in front of the working fluid.

This problem is solved according to certain preferred embodiments of the invention by means of a heat transfer device having a construction consisting of several plates which are stacked above one another and have openings, comprising at least one first and at least one second flow duct plate unit, of which the first flow duct plate unit is provided with a group of side-by-side flow duct openings which extend between two plate side areas, and the second flow duct plate unit is provided with two separate groups of side-by-side flow duct openings which extend between two plate side areas, the first and the second flow duct plate units being arranged in an alternating manner in a plate stack and having connection duct openings which are separate from the flow duct openings, and at least one connection cover plate unit arranged between two flow duct plate units respectively while covering flow duct openings of the flow duct plate units with respect to one another and having connection plate unit flow duct openings, wherein the connection duct openings in the flow duct plate units and in the at least one connection cover plate unit for forming one distributor and collector duct pair respectively for each of the three groups of side-by-side flow duct openings are arranged such that a first pair of connection duct openings of a respective connection cover plate unit overlaps, on the one hand, with a first pair of corresponding connection duct openings of an adjoining first flow duct plate unit and, on the other hand, with the respective ends of the corresponding one group of flow duct openings of an adjoining second flow duct plate unit, a second pair of connection duct openings of the connection cover plate unit overlaps, on the one hand, with a second pair of corresponding connection duct openings of the first flow duct plate unit and, on the other hand, with respective ends of the corresponding other group of flow duct openings of the second flow duct plate unit, and a third pair of connection duct openings of the connection cover plate unit overlaps, on the one hand, with a pair of corresponding connection duct openings of the second flow duct plate unit and, on the other hand, with respective ends of the group of flow duct openings of the first flow duct plate unit.

For implementing the plate stack construction of this heat transfer device, plate units are only required which are provided with suitable openings which can be produced at low expenditures, for example, by means of stamping, eroding, laser beam or water jet cutting. The flow duct openings of the flow duct plate units form the heat-exchange-active flow ducts which extend perpendicularly to the stacking direction and are each bounded by adjacent connection cover plate units. In addition to this flow duct cover function, the connection cover plate units simultaneously carry out a connecting function which includes, by means of corresponding connection duct openings, in each case, the providing of a fluid connection for the equal-sided ends of the flow duct openings of a respective flow duct plate unit with respect to one another. By way of additional, appropriately overlapping connection duct openings of adjoining plate units, specifically of connection cover plate units as well as of flow duct plate units, in addition, in each case, the equal-sided ends of the flow duct openings of the next but one flow duct plate units are in a fluid connection with one another.

By means of the use of two different types of flow duct plate units alternating in the stack, up to three fluid flows can be guided separately from one another through the very compactly constructed heat transfer device, specifically a first fluid by way of the group of the flow duct openings of one or several first flow duct plate units; a second fluid by way of one of the two groups of flow duct openings of one or several second flow duct plate units; and a third fluid by way of its other group of flow duct openings. The fluid flow guided through the at least one first flow duct plate unit is preferably situated in the crosscurrent to the two fluid flows guided through the at least one second flow duct plate unit. By means of a corresponding external connecting of a fluid outlet side of one of the groups of flow duct openings with a fluid inlet side of another group, the heat transfer device is particularly suitable for the guiding through of two fluids while returning the one fluid guided once through a group of flow duct openings into the plate stack for the purpose of another thermal interaction with at least one of the two fluid flows passing through the other groups of flow duct openings. By way of the length of the plate units in the longitudinal direction of the flow duct openings, the effective heat exchange length can be set, and, by way of the number of plate units stacked above one another, the effective flow cross-section for the respective fluid flow can be adjusted. A suitable structuring and stacking of the flow duct plate units and of the connection cover plate units permits, in addition to the implementation of crosscurrent heat transfer devices also the implementation of countercurrent and co-current heat transfer devices of this type.

In the case of certain preferred embodiments of the invention, a fluid flow sent through the flow duct openings of the first flow duct plate units can thermally interact successively first with a fluid flow guided through the first group of flow duct openings of the second flow duct plate units and subsequently with a fluid flow guided through its second group of flow duct openings, while no significant thermal interaction exists between the two separate fluid flows in the second flow duct plate units.

In certain preferred embodiments, a fluid entering by way of the distributor duct of the first flow duct plate units can be tempered by a fluid guided through one group of flow duct openings of the second flow duct plate units and subsequently, for the purpose of a thermal interaction with its own, still not yet tempered fluid flow, can again be sent through the heat transfer device plate stack in order to compensate a previously occurred excess tempering. This heat transfer device is particularly well suited for the above-described special case of a high-temperature battery cooling in which the battery fluid, for the purpose of being guided through a pump, must first be cooled beyond the desired extent and must then be slightly heated again.

The placing of insulating slot openings provided in a further development of the invention permits a reduction of the wall temperature of the heat transfer device plate stack in the corresponding area and particularly, in the case of the use as a cooling element, a reduction of the heat losses.

Other objects, advantages and novel features of the present invention will become apparent from the following detailed description of the invention when considered in conjunction with the accompanying drawings.

DETAILED DESCRIPTION OF THE DRAWINGS

Figure 1:
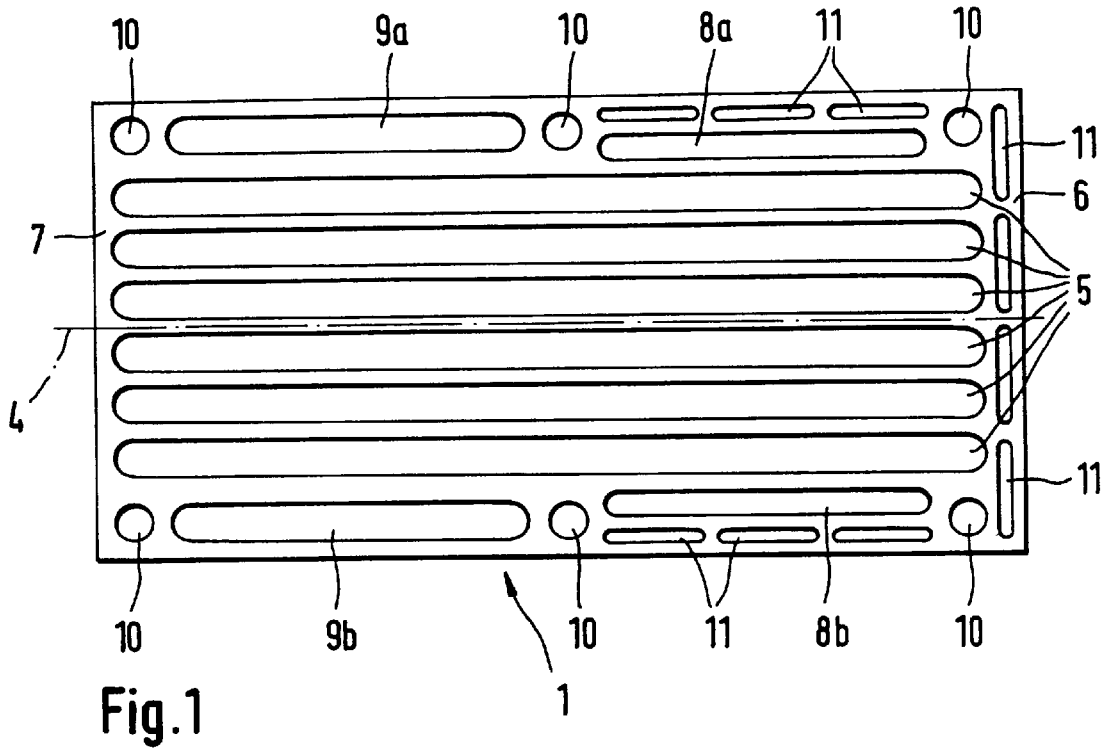
FIG. 1 is a top view of a first flow duct plate for use in a plate stack construction of a heat transfer device for high-temperature battery cooling, constructed according to a preferred embodiment of the present invention.
Figure 2:
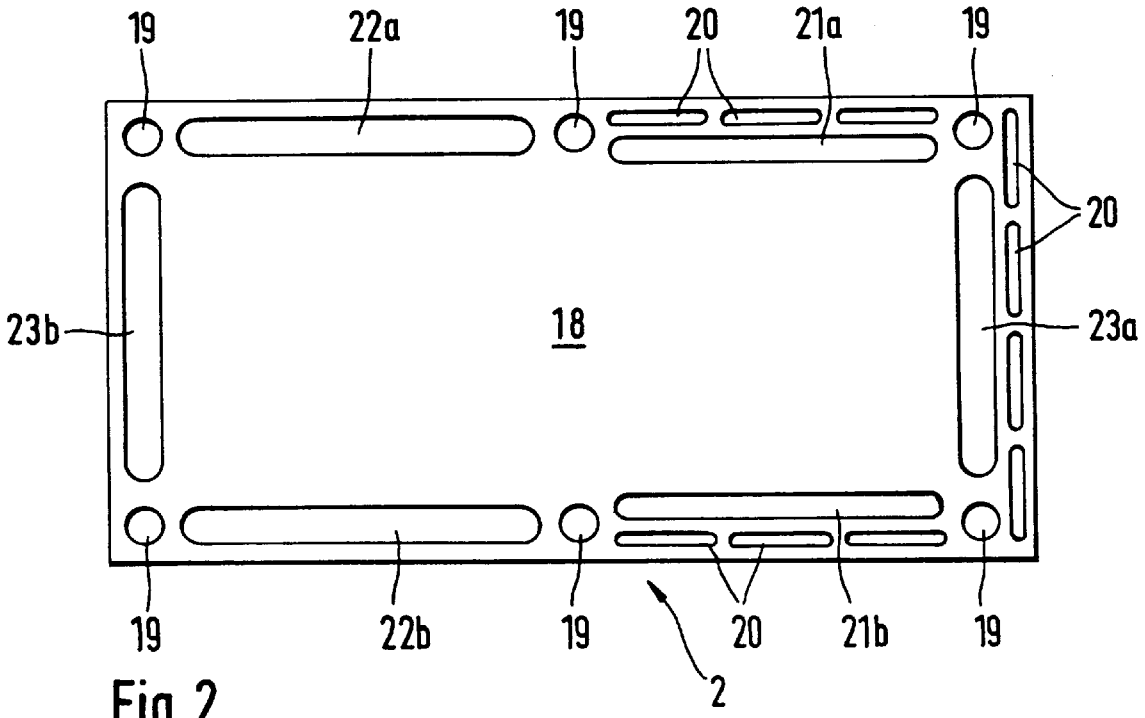
FIG. 2 is a top view of a connection cover plate for use in the same plate stack construction as that of the flow duct plate of FIG. 1.
Figure 3:
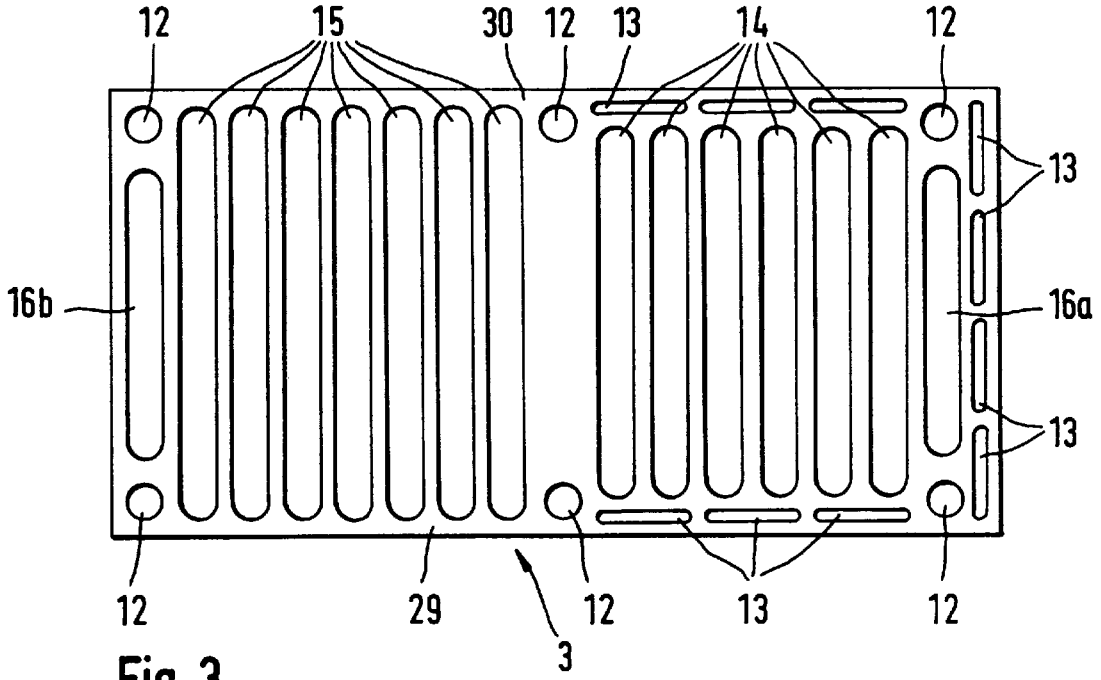
FIG. 3 is a top view of a second flow duct plate for use in the same plate stack construction as that of the plates of FIGS. 1 and 2.
Figure 4:
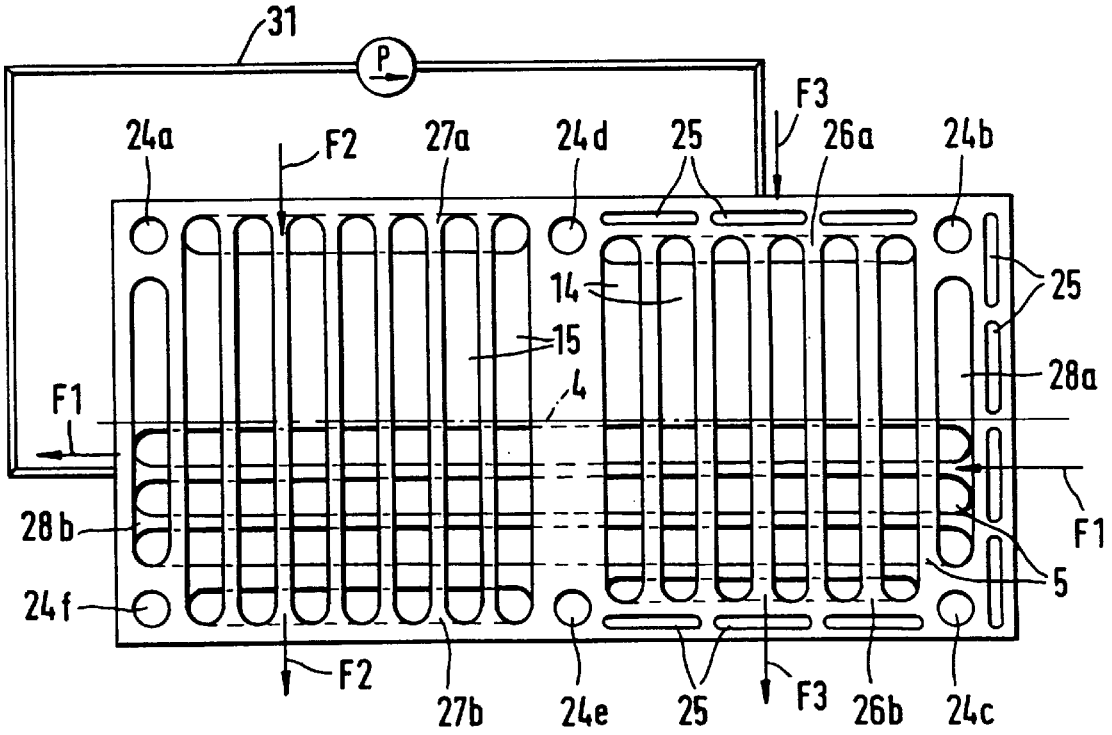
FIG. 4 is a schematic top view of a heat transfer device plate stack construction provided by the stacking of the plates of FIGS. 1 to 3.

FIGS. 1 to 3 show the three different rectangular plate units which are required for the construction of the plate stack illustrated in FIG. 4 and which each consist of one or, as an alternative, of several stacked individual plates of the same type. In particular, FIG. 1 illustrates a first flow duct plate 1; FIG. 2 illustrates a connection cover plate 2; and FIG. 3 illustrates a second flow duct plate 3. All three plates 1, 2, 3 can be produced with technically low expenditures as perforated sheet metal plates in a low-cost manner; for example, by stamping, eroding, laser beam or water jet cutting, and have a conformal overall dimension. The thicknesses of the individual plates may be adapted to the respective application and, for the case of a cooling element for high-temperature battery cooling described here as an example, each typically amount to a few tenths of a millimeter.

The flow duct plate 1 of the first type illustrated in FIG. 1 contains six openings 5 which are arranged side-by-side in parallel to the longitudinal plate axis 4 in a straight line and between the opposite transverse side areas 6, 7 of the plate. This group of flow duct openings 5 is followed in the transverse direction on both sides in a respective transverse plate half, by a first pair 8*a*, 8*b* and a second pair of opposite, elongated connection duct openings 9*a*, 9*b*. In the four corner areas as well as on both sides of the transverse plate center, respective bores 10 are placed through which, during the production of the plate stack, in each case one turnbuckle can be guided. Along the three edge sides of the right transverse plate half, between the marginal edge and the connection duct openings 8*a*, 8*b* provided there adjacent the ends of the flow duct openings 5 provided there, a row of insulating slot openings 11 is arranged by means of which air cushions may be formed for the better thermal insulation of this plate stack area.

The flow duct plate 3 of the second type illustrated in FIG. 3, at points which coincide with those of the flow duct plate 1 of FIG. 1, has six corresponding turnbuckle openings 12 and a row of edge-side insulating slot openings 13. Furthermore, it has a first group of six flow duct openings 14 which extend side-by-side in parallel to the transverse plate axis in a straight line and are arranged in one transverse plate half which is on the right in FIG. 3. A second group of seven flow duct openings 15 which extend side-by-side in parallel to the transverse plate axis in a straight line are placed in the left transverse plate half. Separately from these flow duct openings 14, 15, which extend between the opposite longitudinal plate sides 29, 30, an elongated connection duct opening 16*a*, 16*b* is arranged along each transverse plate side.

According to FIG. 2, the connection cover plate 2 inserted in the plate stack construction in each case between a first 1 and a second flow duct plate 3, is not perforated in a center cover area in order to keep the flow duct openings 5, 14, 15 of the flow duct plates 1, 3 adjoining on both sides, in each case, separate. from one another. Furthermore, the connection cover plate 2 has turnbuckle bores 19 which correspond to those of the flow duct plates 1, 3, as well as a row of insulating slot openings 20 along the edge area of the right transverse plate half at the same position as the insulating slot openings 11, 13 in the flow duct plates 1, 3. Furthermore, in the connection duct plate 2, a first pair 21*a*, 21*b*, a second pair 22*a*, 22*b* and a third pair of connection duct openings 23*a*, 23*b* are placed in such a manner that each of these connection duct openings 21*a* to 23*b*, on the one side, is aligned with one of the connection duct openings 8*a*, 8*b*; 9*a*, 9*b*; 16*a*, 16*b* in one of the two flow duct plates 1, 3 adjoining the connection cover plate 2 on opposite sides and, on the other side, overlaps with respective assigned ends of a respective group of flow duct openings 5, 14, 15 in the other adjoining flow duct plate.

FIG. 4 illustrates the plate stack. achieved by the stacking of the three plates of FIGS. 1 to 3. This demonstrates that, on the one hand, the turnbuckle bores in each case placed at corresponding points in the three plates 1, 2, 3 for forming six turnbuckle passages 24*a* to 24*f* and the rows of oblong insulating slot openings 11, 13, 20 formed in the three plates 1 to 3 on the one transverse half on the edge side in a surrounding manner overlap in an aligned manner for forming a corresponding row of thermally insulating slots 25 along the three lateral areas of the plate stack half on the right in FIG. 4. Furthermore, the first pair of connection duct openings 21*a*, 21*b* of the connection cover plate 2 overlaps in an aligned manner with the first pair of connection duct openings 8*a*, 8*b* of the first flow duct plate 1 for forming two mutually is opposite connection ducts 26*a*, 26*b* of which one forms a distributor duct and the other forms a collector duct, between which the first group of flow duct openings 14 of the second flow duct plate 3 extends in a fluid connecting manner. In the same manner, the second pair of connection duct openings 22*a*, 22*b* of the connection cover plate 2 overlaps in an aligned manner with the second pair of connection duct openings 9*a*, 9*b* of the first flow duct plate 1 for forming a further connection duct pair 27*a*, 27*b* of which, in turn, one forms a distributor duct and the other forms a collector duct, between which the second group of flow duct openings 15 of the second flow duct plate 3 extends in a fluid-connecting manner. Further, the third pair of oblong connection duct openings 23*a*, 23*b* of the connection cover plate 2 overlaps in an aligned manner the pair of connection duct openings 16*a*, 16*b* placed in the second flow duct plate 3, for forming a third pair of connection ducts 28*a*, 28*b*, of which, in turn, one forms a distributor duct and the other forms a collector duct, between which the flow duct openings 5 of the first flow duct plate 1, which are situated in parallel to the longitudinal plate axis 4, extend in a fluid-connecting manner, in which case, for reasons of clarity, FIG. 4 shows only one half of these flow duct openings 5. All flow duct openings 5, 14, 15, typically and without being limited thereto, have a width of from 1 mm to 10 mm.

The plate stack illustrated in FIG. 4 and consisting of the two flow duct plates 1, 3 and the intermediate connection cover plate 2 represents the construction which is minimally required for the heat transfer function according to the invention, in which case this construction naturally is closed off on both sides by respective end plates which are not shown and which have only the turnbuckle bores and the insulating slot openings at the corresponding points. According to the application, this minimal plate stack construction can be supplemented by additional plates, in which case, for the purpose of an optimal heat transmission between a fluid flow through the flow duct openings 5 of the first flow duct plate 1, on the one hand, and the fluid flows in the two other groups of flow duct openings 14, 15, which are placed in the second flow duct plates 3, the first 1 and the second flow duct plates 3 are in each case, with the insertion of a connection cover plate 2, arranged in an alternating manner in the stack. For assembling the plate stack construction, the individual plates are connected with one another, for example, by means of gluing, soldering or diffusion welding in a fluid-tight manner. Independently of the number of plates selected for the respective use, as illustrated in FIG. 4, three fluid flows (F1, F2, F3) are guided separately from one another through the heat transfer device plate stack construction, in which case the two fluid flows (F2, F3), which are guided separately from one another in a respective transverse stack half through the second flow duct plates 3, are in a cross-current with respect to the fluid flow (F1) guided in the longitudinal direction through the first flow duct plates 1.

Furthermore, in a manner which is not shown, connections for each flow duct 26*a* to 28*b* out of the plate stack are provided, for the purpose of which either the plate stack can be bored laterally at the suitable points or fitting connection openings can be placed in one or both stack end plates. As another alternative, the placing of a connection cover plate is possible which is designed especially as a connecting plate, in which case such a connecting plate is modified in that, for each connection duct opening 21*a* to 23*b*, a fluid connection to the outside is provided by corresponding recesses on the lateral plate areas.

In an intended usage of this plate stack construction as a cooling element for high-temperature battery cooling, for example, the first fluid flow (F1) represents a silicone cooling fluid coming from the battery which, introduced into the distributor duct 28*a* situated on the right in FIG. 4, is distributed from there to the flow duct openings 5 of the one or several first flow duct plates 1 and is guided through these, after which it is guided together again in the opposite collector duct 28*b* and from there leaves the plate stack. As a second fluid (F2), a cooling fluid, such as cooling water, is guided in the crosscurrent with respect to the above-mentioned cooling fluid flow (F1), through the left transverse half of the plate stack while entering into the distributor duct 27*a*, flowing through the group, on the left side in FIG. 4, of flow duct openings 15 of the one or several second flow duct plates 3, and the opposite outlet from the corresponding collector duct 27*b*. As the third fluid flow (F3) guided through the group, situated on the right in FIG. 4, of flow duct openings 14 of the one or several second flow duct plates 3, the silicone cooling fluid (F1) is used which already flowed through the plate stack in the longitudinal direction, in which case this silicone cooling fluid (F1), after the longitudinal-side flowing through the plate stack, is guided by way of a return line 31 indicated in a block diagram in FIG. 4 which contains a circulating pump (P) required for the cooling fluid circulation, and is fed into the corresponding distributor duct 26*a*.

By means of this measure, the following desired effect can be achieved. The silicone fluid (F1) coming out of the battery which is to be cooled is guided in the longitudinal direction through the plate stack construction and, in this case, is first precooled on the first plate half by the very cooled, returned cooling fluid flow (F3) in the crosscurrent, after which it is cooled in the second plate half by the cooling water flow (F2) also in the crosscurrent completely to the temperature desired on the inlet side of the circulation pump (P). The cooling fluid flowing though the pump (P) is therefore at a temperature which is not damaging to this pump (P) which, however, is inappropriately low for the reintroduction of the cooling fluid into the battery because it is too far below the working temperature of this battery. Therefore, the cooling fluid from the outlet side of the pump (P) is used as the third fluid flow (F3) for the precooling of the hot cooling fluid flow (F1) coming from the battery, whereby the cooling oil (F3) is heated, by again passing through the plate stack to the temperature suitable for another introduction into the battery and leaves the stack by way of the corresponding collector duct 26*b*. It is understood that the plate stack construction as well as the inlet temperature and the flow rate of the cooling fluid (F2) must in each case be designed such that, on the one hand, after the first passage through the plate stack, the cooling fluid is cooled to a temperature which is sufficiently low for avoiding pump damage and, on the other hand, during the second passage through the plate stack, is tempered to precisely the desired battery inlet temperature. By means of the row of the insulating slots 25 extending in the stacking direction on the plate stack half which faces the inlet side of the hot cooling fluid (F1) coming from the battery, a reduction of the wall temperature in this plate stack area and a reduction of the heat losses is achieved. By means of this heat transfer arrangement, it is therefore possible to exactly lead away in a desirable manner the heat, which is due to energy loss, from the battery, without, on the one hand, an insufficient cooling or, on the other hand, an excessive cooling leading to losses of electric battery energy.

It is understood that the illustrated and described heat transfer device can also be used for other applications, in which two separate fluid flows flow in the crosscurrent to another fluid flow while using a single compact plate stack construction and are to thermally interact with it, in which case, by means of the corresponding fluid return, at least one of the three entering fluid flows can be formed by a fluid flow which flowed through the plate stack at least one. While the space requirement is low, the plate stack construction according to the invention offers a high heat transfer output and can be produced by means of low expenditures.

Furthermore, it is understood, that the invention determined by the claims is not limited to the concretely illustrated plate stack construction. For example, in addition to the illustrated rectangular shape, the individual plates may have any other two-dimensional shape, and the flow duct openings do not necessarily have to extend between opposite plate side areas and also not necessarily in a straight line. As an alternative, they may, for example, also extend in a curved or bent shape.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Heat transfer device having a construction consisting of several plates which are stacked above one another and have openings, comprising:

at least one first and at least one second flow duct plate unit, of which the first flow duct plate unit is provided with a group of side-by-side flow duct openings which extend between two plate side areas, and the second flow duct plate unit is provided with two separate groups of side-by-side flow duct openings which extend between two plate side areas, the first and the second flow duct plate units being arranged in an alternating manner in a slate stack and having connection duct openings which are separate from the flow duct openings, and at least one connection cover plate unit arranged between respective first and second flow duct plate units while covering flow duct openings of the respective first and second flow duct plate units with respect to one another and having connection plate unit flow duct openings, wherein the connection duct openings in the flow duct plate units and in the at least one connection cover plate unit form one distributor and collector duct pair respectively for each of three groups of side-by-side flow duct openings and are arranged such that a first pair of connection duct openings of a respective connection cover plate unit overlaps, on the one hand, with a first pair of corresponding connection duct openings of an adjoining first flow duct plate unit and, on the other hand, with respective ends of a corresponding group of flow duct openings of an adjoining second flow duct plate unit, a second pair of connection duct openings of the connection cover plate unit overlaps, on the one hand, with a second pair of corresponding connection duct openings of the first flow duct plate unit and, on the other hand, with respective ends of a corresponding other group of flow duct openings of the second flow duct plate unit, and a third pair of connection duct openings of the connection cover slate unit overlaps, on the one hand, with a pair of corresponding connection duct openings of the second flow duct plate unit and, on the other hand, with respective ends of the group of flow duct openings of the first flow duct plate unit, wherein the flow duct openings in the at least one first flow duct plate unit extend essentially transversely to the two groups of flow duct openings of the at least one second flow duct plate unit, the two groups of flow duct openings of the second flow duct plate unit being arranged in a longitudinal direction of the flow duct openings of the at least one first flow duct plate unit behind one another, and further comprising a plate-stack-external fluid connection between the collector duct for the flow duct openings of the at least one first flow duct plate unit and distributor duct of one of the two groups of flow duct openings of the at least one second flow duct plate unit.

2. Heat transfer device according to claim 1, comprising insulating slot openings which are placed at least along a portion of plate edge areas for the formation of thermally insulating slots, which extend in the plate stacking direction, in an aligned corresponding relationship in the flow duct plate units as well as in the at least one connection cover plate unit.

3. Heat transfer device according to claim 1, wherein said plate units include rectangular plates which are clamped together along outer edges of said plates.

4. Heat transfer device having a construction consisting of several plates which are stacked above one another and have openings, comprising:

at least one first and at least one second flow duct plate unit, of which the first flow duct plate unit is provided with a group of side-by-side flow duct openings which extend between two plate side areas, and the second flow duct plate unit is provided with two separate groups of side-by-side flow duct openings which extend between two plate side areas, the first and the second flow duct plate units being arranged in an alternating manner in a plate stack and having connection duct openings which are separate from the flow duct openings, and at least one connection cover plate unit arranged between respective first and second flow duct plate units while covering flow duct openings of the respective first and second flow duct plate units with respect to one another and having connection plate unit flow duct openings, wherein the connection duct openings in the flow duct plate units and in the at least one connection cover plate unit form one distributor and collector duct pair respectively for each of three groups of side-by-side flow duct openings and are arranged such that a first pair of connection duct openings of a respective connection cover plate unit overlaps, on the one hand, with a first pair of corresponding connection duct openings of an adjoining first flow duct plate unit and, on the other hand, with respective ends of a corresponding group of flow duct openings of an adjoining second flow duct plate unit, a second pair of connection duct openings of the connection cover plate unit overlaps, on the one hand, with a second pair of corresponding connection duct openings of the first flow duct plate unit and, on the other hand, with respective ends of a corresponding other group of flow duct openings of the second flow duct plate unit, and a third pair of connection duct openings of the connection cover plate unit overlaps, on the one hand, with a pair of corresponding connection duct openings of the second flow duct plate unit and, on the other hand, with respective ends of the group of flow duct openings of the first flow duct plate unit, and further comprising insulating slot openings which are placed at least along a portion of plate edge areas for the formation of thermally insulating slots, which extend in the plate stacking direction, in an aligned corresponding relationship in the flow duct plate units as well as in the at least one connection cover plate unit.

5. Heat transfer device according to claim 4, wherein said plate units include rectangular plates which are clamped together along outer edges of said plates.

6. Heat transfer device having a construction consisting of several plates which are stacked above one another and have openings, comprising:

at least one first and at least one second flow duct plate unit, of which the first flow duct plate unit is provided with a group of side-by-side flow duct openings which extend between two plate side areas, and the second flow duct plate unit is provided with two separate groups of side-by-side flow duct openings which extend between two plate side areas, the first and the second flow duct plate units being arranged in an alternating manner in a plate stack and having connection duct openings which are separate from the flow duct openings, and at least one connection cover plate unit arranged between respective first and second flow duct plate units while covering flow duct openings of the respective first and second flow duct plate units with respect to one another and having connection plate unit flow duct openings, wherein the connection duct openings in the flow duct plate units and in the at least one connection cover plate unit form one distributor and collector duct pair respectively for each of three groups of side-by-side flow duct openings and are arranged such that a first pair of connection duct openings of a respective connection cover plate unit overlaps, on the one hand, with a first pair of corresponding connection duct openings of an adjoining first flow duct plate unit and, on the other hand, with respective ends of a corresponding group of flow duct openings of an adjoining second flow duct plate unit, a second pair of connection duct openings of the connection cover plate unit overlaps, on the one hand, with a second pair of corresponding connection duct openings of the first flow duct plate unit and, on the other hand, with respective ends of a corresponding other group of flow duct openings of the second flow duct plate unit, and a third pair of connection duct openings of the connection cover plate unit overlaps, on the one hand, with a pair of corresponding connection duct openings of the second flow duct plate unit and, on the other hand, with respective ends of the group of flow duct openings of the first flow duct plate unit, wherein the flow duct openings in the at least one first flow duct plate unit extend essentially transversely to the two groups of flow duct openings of the at least one second flow duct plate unit, the two groups of flow duct openings of the second flow duct plate unit being arranged in a longitudinal direction of the flow duct openings of the at least one first flow duct plate unit behind one another, and further comprising insulating slot openings which are placed at least along a portion of plate edge areas for the formation of thermally insulating slots, which extend in the plate stacking direction, in an aligned corresponding relationship in the flow duct plate units as well as in the at least one connection cover plate unit.

* * * * *